US008721276B2

(12) United States Patent
Lu et al.

(10) Patent No.: US 8,721,276 B2
(45) Date of Patent: May 13, 2014

(54) FAN MODULE AND FAN RAIL THEREOF

(75) Inventors: Tung-Ke Lu, Taipei Hsien (TW); Chieh-Shih Yi, Taipei Hsien (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 862 days.

(21) Appl. No.: 12/845,780

(22) Filed: Jul. 29, 2010

(65) Prior Publication Data

US 2012/0027580 A1 Feb. 2, 2012

(51) Int. Cl.
*F04D 29/40* (2006.01)

(52) U.S. Cl.
USPC ..... 415/213.1; 361/679.46

(58) Field of Classification Search
USPC ..... 415/213.1, 214.1, 220, 223; 454/184, 454/248
See application file for complete search history.

(56) References Cited

U.S. PATENT DOCUMENTS 6,592,327 B2 * 7/2003 Chen et al. ..... 415/213.1
7,481,704 B2 * 1/2009 Kao et al. ..... 454/184
7,611,328 B2 * 11/2009 Peng et al. ..... 415/213.1
7,699,582 B2 * 4/2010 Tao ..... 415/213.1
7,771,165 B2 * 8/2010 Chen ..... 415/213.1
7,839,638 B2 * 11/2010 Ye et al. ..... 361/695
2006/0203446 A1 * 9/2006 Radhakrishnan et al. .... 361/695

FOREIGN PATENT DOCUMENTS

TW 200806893 2/2008

OTHER PUBLICATIONS

"Office Action of Taiwan Counterpart Application", issued on Mar. 28, 2013, p. 1-p. 4, in which the listed reference was cited.

* cited by examiner

*Primary Examiner* — Nathaniel Wiehe
*Assistant Examiner* — Woody A Lee, Jr.
(74) *Attorney, Agent, or Firm* — Jianq Chyun IP Office

(57) ABSTRACT

A fan module and a fan rail thereof are provided. The fan module includes a fan, two fan rails and a holder. The fan rails are respectively disposed at opposite sides of the fan, and each of the fan rails includes a main body and a ring-pull, wherein the ring-pull has a tab portion and a pivot portion, and the pivot portion is pivoted with a first end of the main body. The fan is installed in the holder through the fan rails. The fan is adapted to be drawn out from the holder in an unlock state by rotating the tab portion of each of the fan rails along the pivot portion with respect to the main body and applying a pulling force to the tab portion.

11 Claims, 9 Drawing Sheets

350

FAN MODULE AND FAN RAIL THEREOF

BACKGROUND OF THE INVENTION

1. Field of the Invention

The present invention relates to a fan module, and more particularly to a fan module and fan rails thereof.

2. Description of Related Art

The recent designs of handles of fan rails are not suitable for all types of fans, and thus as being applied to a high speed fan module, the arrangement and usage of handle of fan are restricted by reinforcing ribs which are used for enhancing a structural rigidness of the fan.

FIGS. 1A and 1B illustrate a conventional fan and fan rails thereof. Fan blades of the fan are not shown in FIGS. 1A and 1B. Referring to FIGS. 1A and 1B, the fan rails 120 are disposed on opposite sides of the fan 110 without an air inlet or outlet, wherein a top portion of the fan rail 120 has an L-shaped elastic arm 122, an end of the elastic arm 122 is hollowed form a ring portion, and the elastic arm 122 has a stopping block 124. When the fan 110 is installed in a holder (not shown) through the fan rails 120, the stopping blocks 124 are engaged with and limited in the holder so as to steadily fix the fan 110 in the holder.

When detaching the fan 110 from the holder, two fingers of a user are respectively inserted into the ring portions of the elastic arms 122 of the two fan rails 120, and the two ring portions are pulled in opposite directions to draw the two elastic arms 122 closer with each other for releasing the engagement between the stopping blocks 124 and the holder, and then the two fan rails 120 are pulled upward to draw the fan 110 out from the holder.

The aforementioned fan rails 120 facilitate detaching the fan 110 from the holder. However, to different electronic devices, the rotational speed of the fan 110 is varied to meet different requirements. When the rotational speed of the fan 110 is extremely high, the fan 110 is provided with reinforcing ribs 112 located at the ring portion of each of the elastic arms 122, wherein fingers of the user are obstructed by the reinforcing ribs 112 as being inserted into the ring portion, which makes difficulties in the detachment of the fan 110.

SUMMARY OF THE INVENTION

The present invention provides a new fan rail.

The present invention provides a fan module applying the above new fan rails to facilitate installing or detaching the fan module.

The present invention provides a fan rail including a main body and a ring-pull, wherein the ring-pull has a tab portion and a pivot portion, the pivot portion is pivoted with a first end of the main body, and the tab portion is adapted to rotate along the pivot portion with respect to the main body.

In an embodiment of the fan rail of the present invention, the first end of the main body has an accommodating portion and two protrusions, the two protrusions are respectively located on opposite side walls of the accommodating portion, and the pivot portion has two recesses respectively coupled with the two protrusions. The two recesses may be connected with each other to form a through hole.

In an embodiment of the fan rail of the present invention, the main body has four elastic arms, wherein two of the elastic arms are located at opposite sides of the first end of the main body, and the other two elastic arms are located at opposite sides of a second end of the main body.

In an embodiment of the fan rail of the present invention, the main body further has an opening adjacent to the accommodating portion and located between the two elastic arms at the first end.

In an embodiment of the fan rail of the present invention, the ring-pull further has a stopping block disposed at a side of the pivot portion far away from the tab portion.

The present invention further provides a fan module including a fan, two fan rails and a holder. The fan rails are respectively disposed at opposite sides of the fan, and each of the fan rails includes a main body and a ring-pull, wherein the ring-pull has a tab portion and a pivot portion, and the pivot portion is pivoted with a first end of the main body. The fan is installed in the holder through the fan rails. The fan is adapted to be drawn out from the holder in an unlock state by rotating the tab portion of each of the fan rails along the pivot portion with respect to the main body and applying a pulling force to the fan rail.

In an embodiment of the fan module of the present invention, the first end of the main body has an accommodating portion and two protrusions, the two protrusions are respectively located on opposite side walls of the accommodating portion, and the pivot portion has two recesses respectively coupled with the two protrusions. The two recesses may be connected with each other to form a through hole.

In an embodiment of the fan module of the present invention, the main body has four elastic arms, wherein two of the elastic arms are located at opposite sides of the first end of the main body, and the other two elastic arms are located at opposite sides of a second end of the main body.

In an embodiment of the fan module of the present invention, each of the elastic arms has an assembling bump and the fan has a plurality of assembling holes arranged for being engaged with the corresponding assembling bumps.

In an embodiment of the fan module of the present invention, the main body further has an opening adjacent to the accommodating portion and located between the two elastic arms at the first end.

In an embodiment of the fan module of the present invention, each of the ring-pulls further has a stopping block disposed at a side of the pivot portion far away from the tab portion, and the holder has a plurality of slots at its opposite sides for engaging the stopping blocks as the ring-pull is in a lock state.

As to the above, the ring-pull of the fan rail of the present invention can be rotated with respect to the main body of the fan rail, such that when the fan module is installed in the holder, a user can conveniently draw the fan out from the holder by unlocking the ring-pull from the main body, releasing the engagement between the ring-pull and the holder, and then applying a pulling force to the ring-pull of the fan rail.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention.

DESCRIPTION OF EMBODIMENTS

Figure 2A:
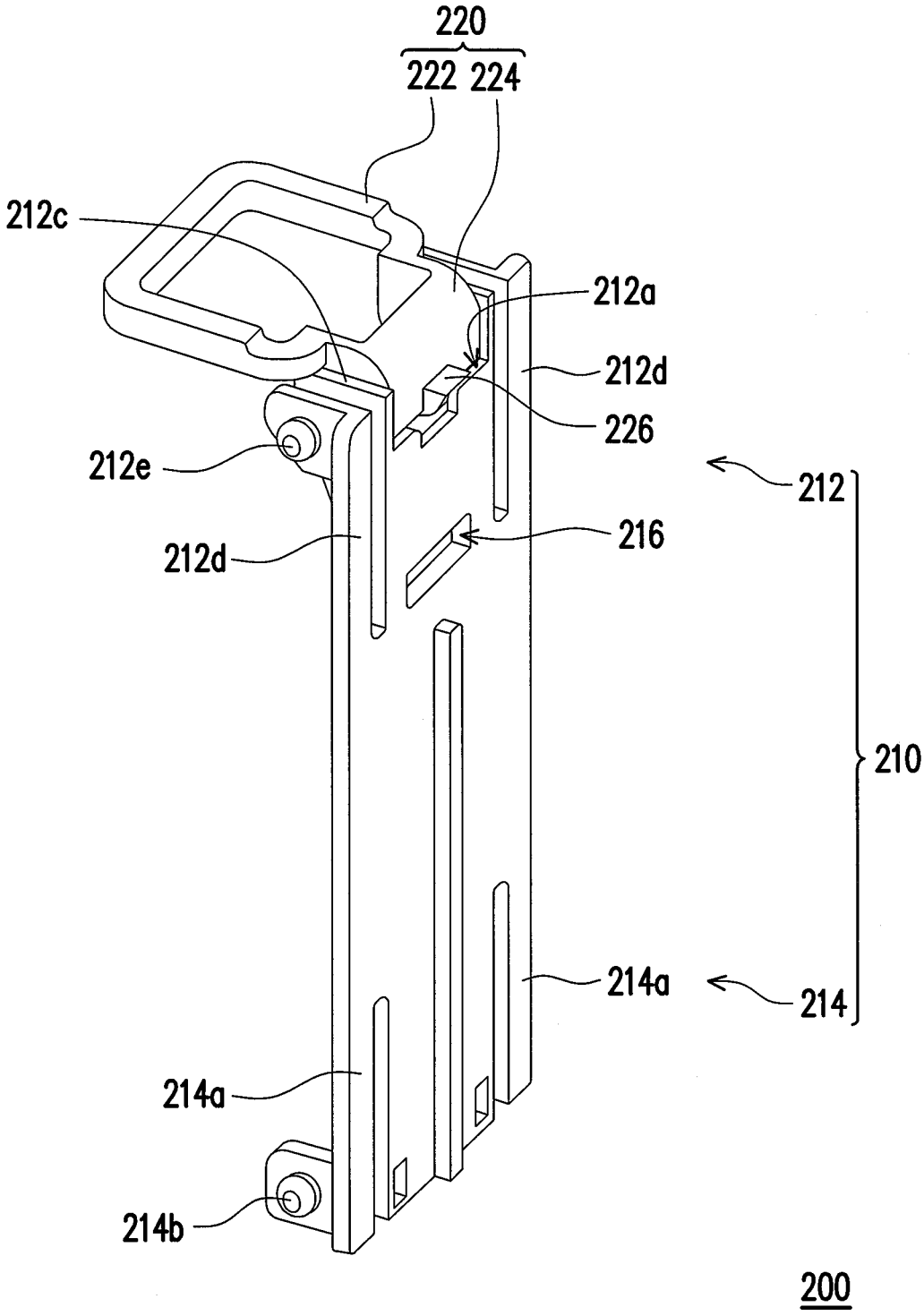
FIG. 2A is a schematic view of a fan rail according to an embodiment of the present invention.
Figure 2B:
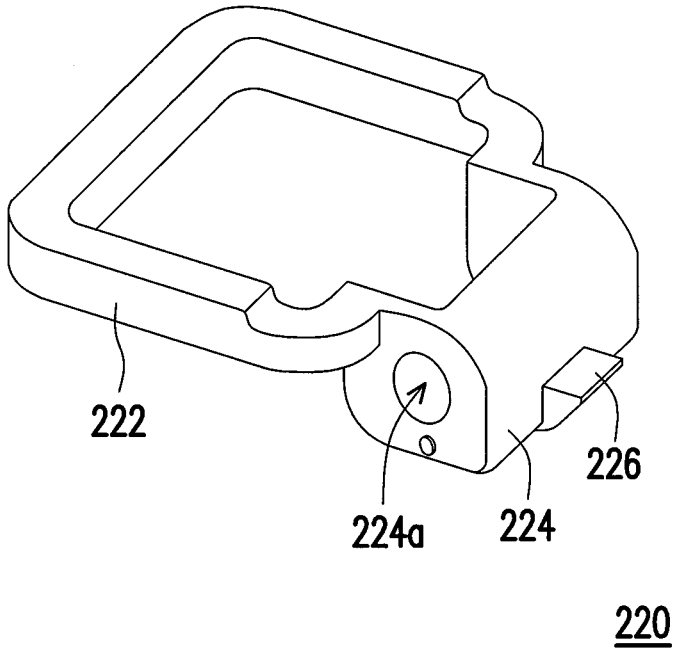
FIG. 2B is a schematic view of a ring-pull of the fan rail depicted in FIG. 2A.
Figure 2C:
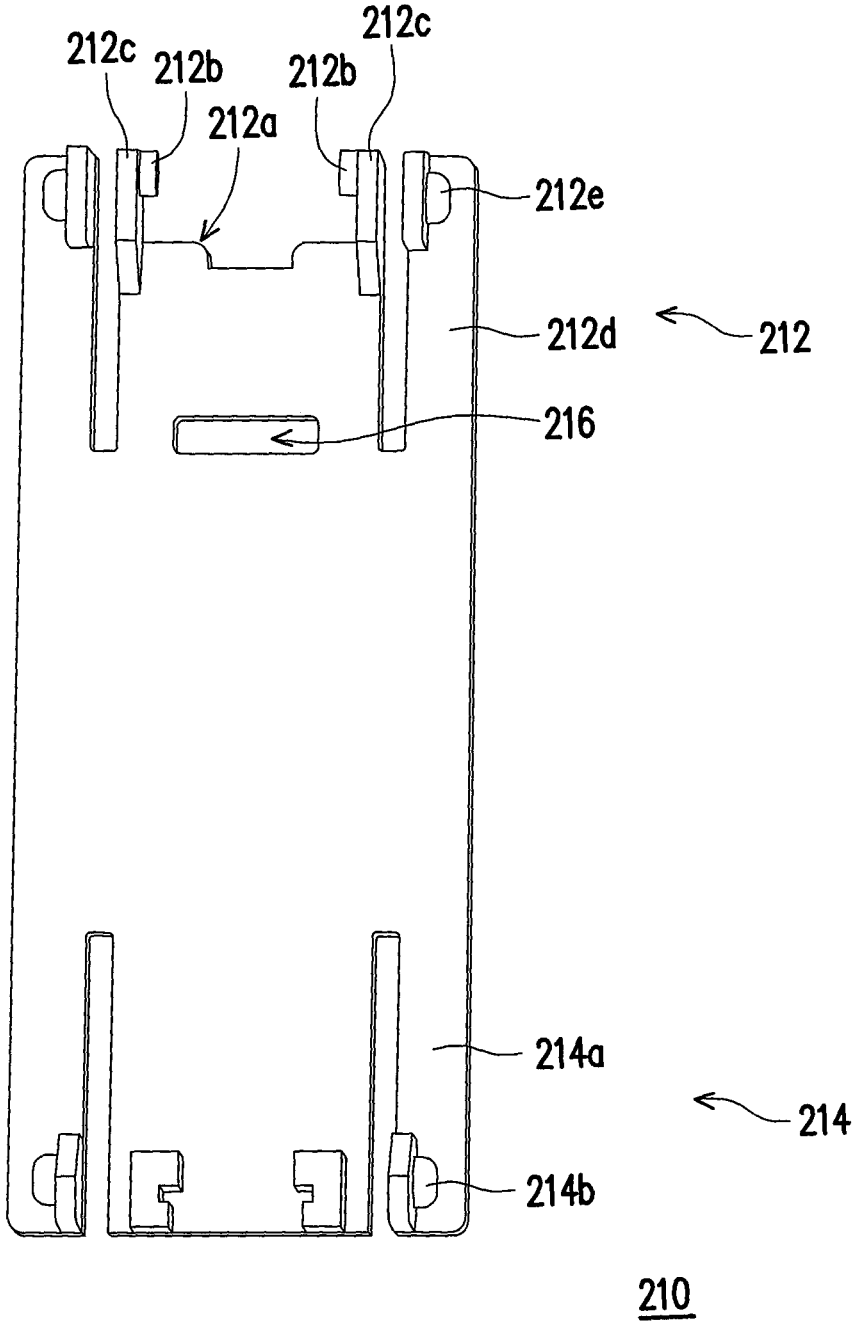
FIG. 2C is a schematic view of a main body of the fan rail depicted in FIG. 2A.

FIG. 2A is a schematic view of a fan rail according to an embodiment of the present invention. FIG. 2B is a schematic view of a ring-pull of the fan rail depicted in FIG. 2A. FIG. 2C is a schematic view of a main body of the fan rail depicted in FIG. 2A. Referring to FIGS. 2A, 2B and 2C, a fan rail 200 includes a main body 210 and a ring-pull 220, wherein the ring-pull 220 has a tab portion 222 and a pivot portion 224, the pivot portion 224 is pivoted with a first end 212 of the main body 210, and the tab portion 222 is adapted to rotate along the pivot portion 224 with respect to the main body 210.

The first end 212 of the main body 210 has an accommodating portion 212*a* and two protrusions 212*b*, the two protrusions 212*b* are respectively located on opposite side walls 212*c* of the accommodating portion 212*a*, and the pivot portion 224 has two recesses 224*a* respectively coupled with the two protrusions 212*b* to pivot the ring-pull 220 with the main body 210. Since the ring-pull 220 is pivoted with the main body 210, the ring-pull 220 is adapted to rotate along the pivot portion 224 with respect to the main body 210. In another embodiment, the two recesses 224*a* can be replaced by two protrusions, while the two protrusions 212*b* can be replaced by two recesses. The present invention provides no limitation on the connecting manner between the ring-pull 220 and the main body 210, as long as the ring-pull 220 can be pivoted with the main body 210 and rotates with respect thereto.

Figure 3:
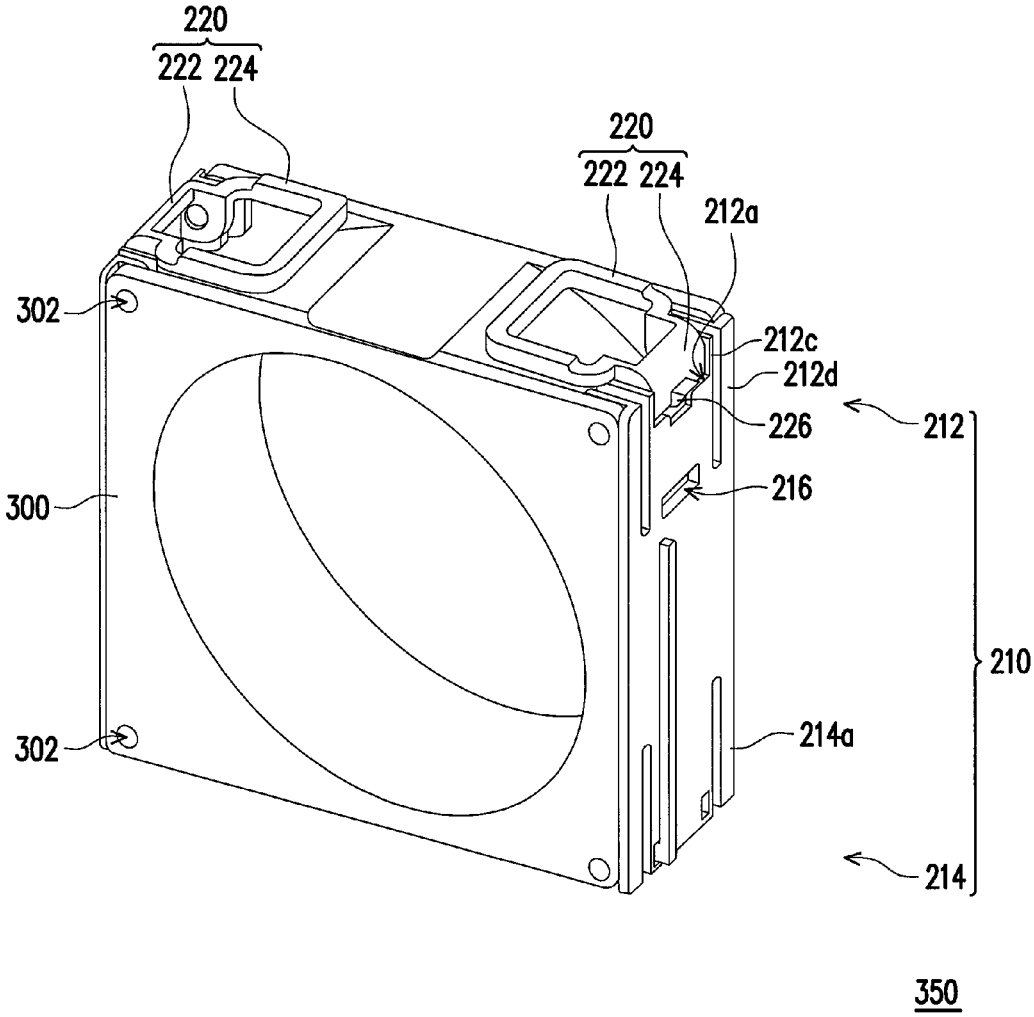
FIG. 3 is a schematic view showing an assembly of a fan and two fan rails as shown in FIG. 2A.

FIG. 3 is a schematic view showing an assembly of a fan and two fan rails as shown in FIG. 2A. Fan blades of the fan are not shown in FIG. 3 and other figures thereinafter. Referring to FIGS. 2A and 3, the fan rails 200 are disposed at opposite sides of the fan 300 to form an assembly 350 of the fan 300 and the fan rails 200.

More specifically, the main body 210 has four elastic arms 212*d* and 214*a*, wherein the two elastic arms 212*d* are located at opposite sides of the first end 212 of the main body 210, and the other two elastic arms 214*a* are located at opposite sides of a second end 214 of the main body 210. In addition, each of the aforementioned elastic arms 212*d* has an assembling bump 212*e*, each of the aforementioned elastic arms 214*a* has an assembling bump 214*b*, and the fan 300 has a plurality of assembling holes 302. When installing the fan rails 200 to the opposite sides of the fan 300, the two elastic arms 214*a* at the second end 214 of the main body 210 are compressed to engage the assembling bumps 214*b* into their corresponding assembling holes 302. Then, the two elastic arms 212*d* at the first end 212 of the main body 210 are compressed to engage the assembling bumps 212*e* into their corresponding assembling holes 302. The arrangement, profile, and quantity of the assembling bumps 212*e*, 214*b* and the assembling holes 302 can be amended to meet practical requirements and are not restricted by the present embodiment. Furthermore, the sequence of installing the first end 212 and the second end 214 to the fan 300 may depends on a usual practice and is not limited by the present embodiment.

Figure 4:
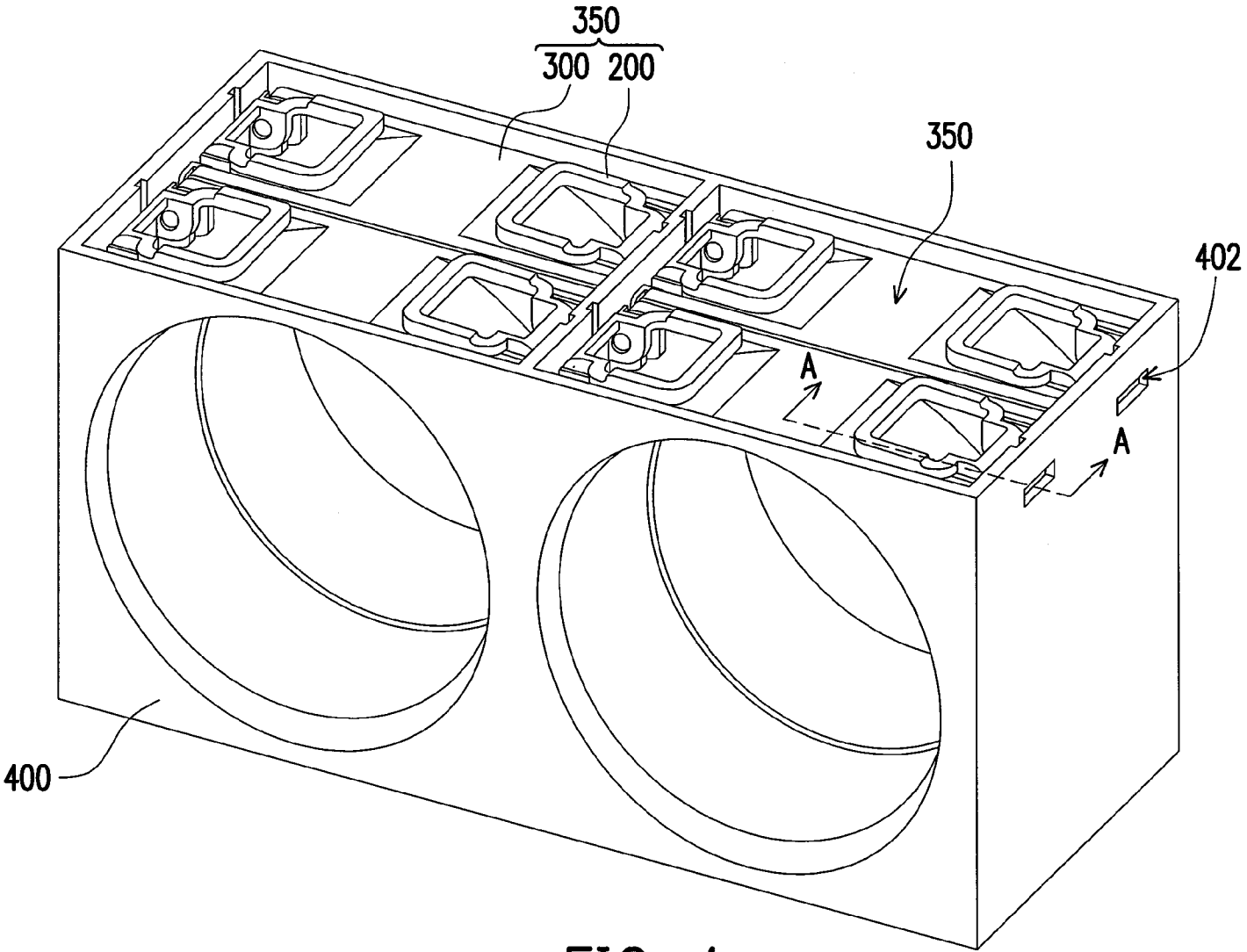
FIG. 4 is a schematic view showing installing the assembly of the fan and the fan rails depicted in FIG. 3 in a holder.

FIG. 4 is a schematic view showing installing the assembly of the fan and the fan rails depicted in FIG. 3 in a holder. Referring to FIGS. 3 and 4, a fan module 500 is provided by installing the assembly of the fan 300 and the fan rails 200 into the holder 400, wherein in the present embodiment four assemblies 350 are reliably accommodated in the holder 400, and the four assemblies 350 are separated from one another. It is understood that the quantity of the assembly 350 accommodated in the holder 400 can be amended according to practical requirements.

Figure 5:
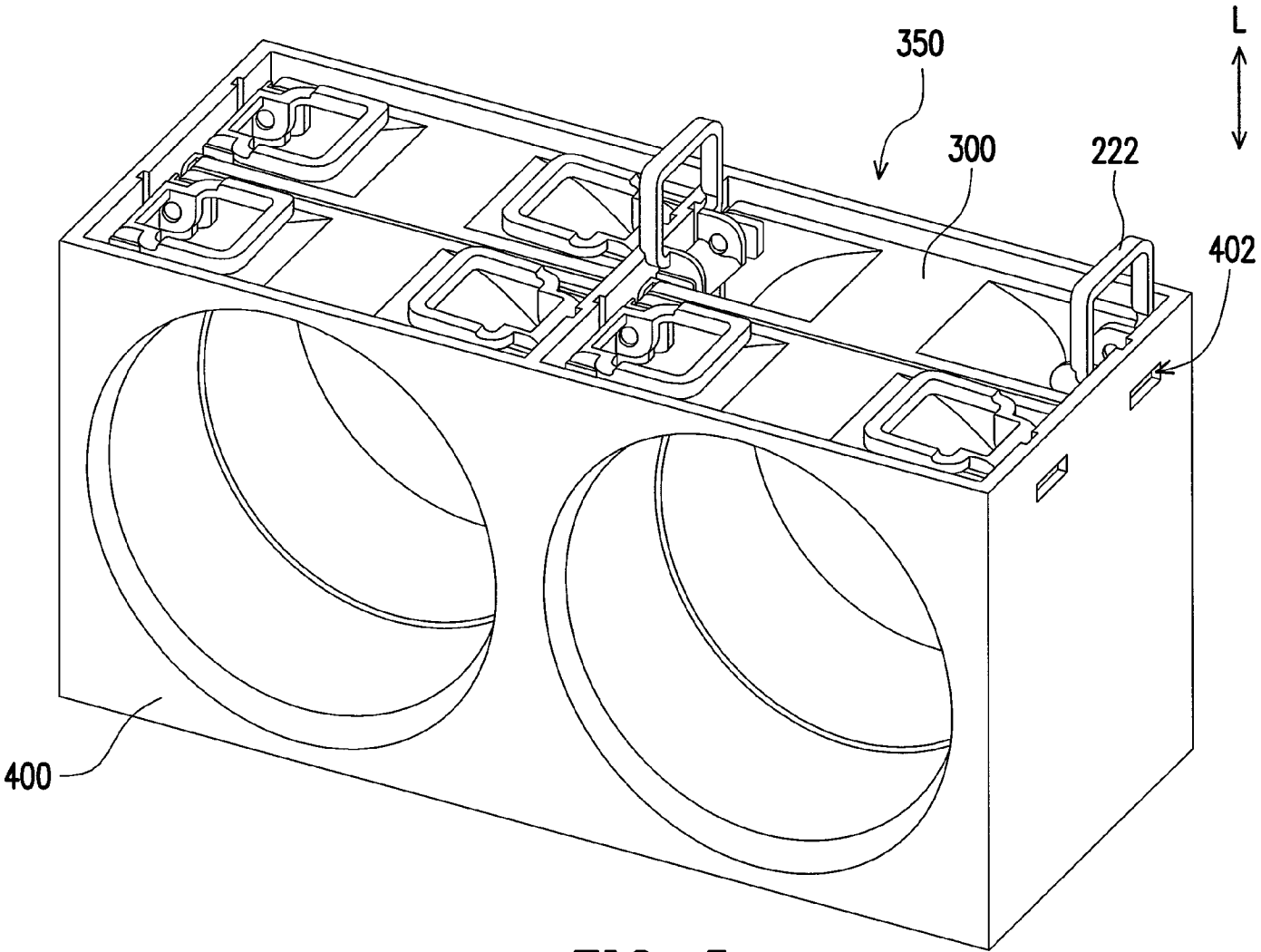
FIG. 5 is a schematic view of a ring-pull of the fan rail depicted in FIG. 4 being in an unlock state.

FIG. 5 is a schematic view of a ring-pull of the fan rail depicted in FIG. 4 being in an unlock state. Referring to FIGS. 3, 4 and 5, in the case of the fan having reinforcing ribs which obstructs the usage of the handle, when users want to detach the assembly 350 from the holder 400, they can insert their fingers into the tab portion 222 of the ring-pull 220 to rotate the tab portion 222 along the pivot portion 224 with respect to the main body 210 and make the tab portion 222 be parallel to a longitudinal direction L of the main body 210. Then, the assembly 350 can be drawn out from the holder 400 by dragging the tab portion 222 with the users' fingers. In addition, as shown in FIG. 4, the assembly 350 can be installed into the holder 400 by applying a force to press the assembly 350 into the holder 400.

Figure 6:
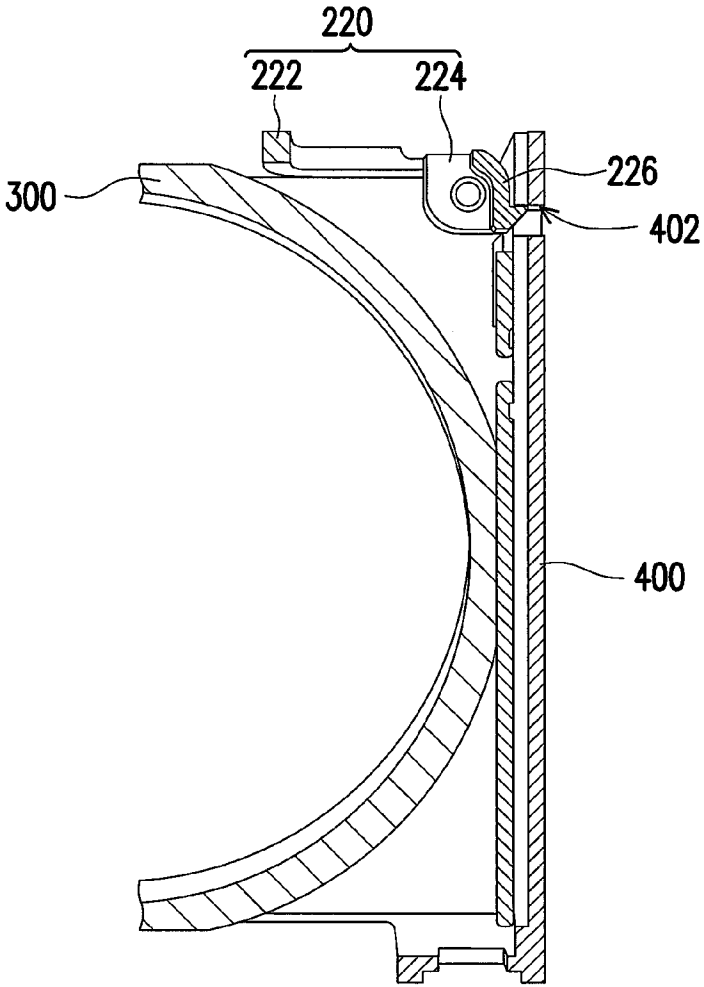
FIG. 6 is a schematic cross-sectional view along line A-A in FIG. 4.

FIG. 6 is a schematic cross-sectional view along line A-A in FIG. 4. Referring to FIGS. 2A, 4 and 6, each of the ring-pulls 222 further has a stopping block 226 disposed at a side of the pivot portion 224 far away from the tab portion 222, and the holder 400 has a plurality of slots 402 at its opposite sides. When the assembly 350 is installed in the holder 400, the ring-pull 220 is rotated, and the tab portion 222 is adjacent to the fan 300 and perpendicular to the longitudinal direction L of the main body 210. At the present, the stopping block 226 is engaged with the slot 402, and the ring-pull 220 is in the lock state.

When users want to detach the assembly 350 from the holder 400, they can insert their fingers into the tab portion 222 of the ring-pull 220 to rotate the tab portion 222 along the pivot portion 224 and make the tab portion 222 be parallel to a longitudinal direction L of the main body 210, and the engagement between the stopping block 226 and the slot 402 can be released. Herein, the ring-pull 220 is in the unlock state. Then, users can conveniently draw the fan 300 out from the holder 400 by pulling the tab portion 222 of the ring-pull 220 of the fan rail 200.

Figure 1A:
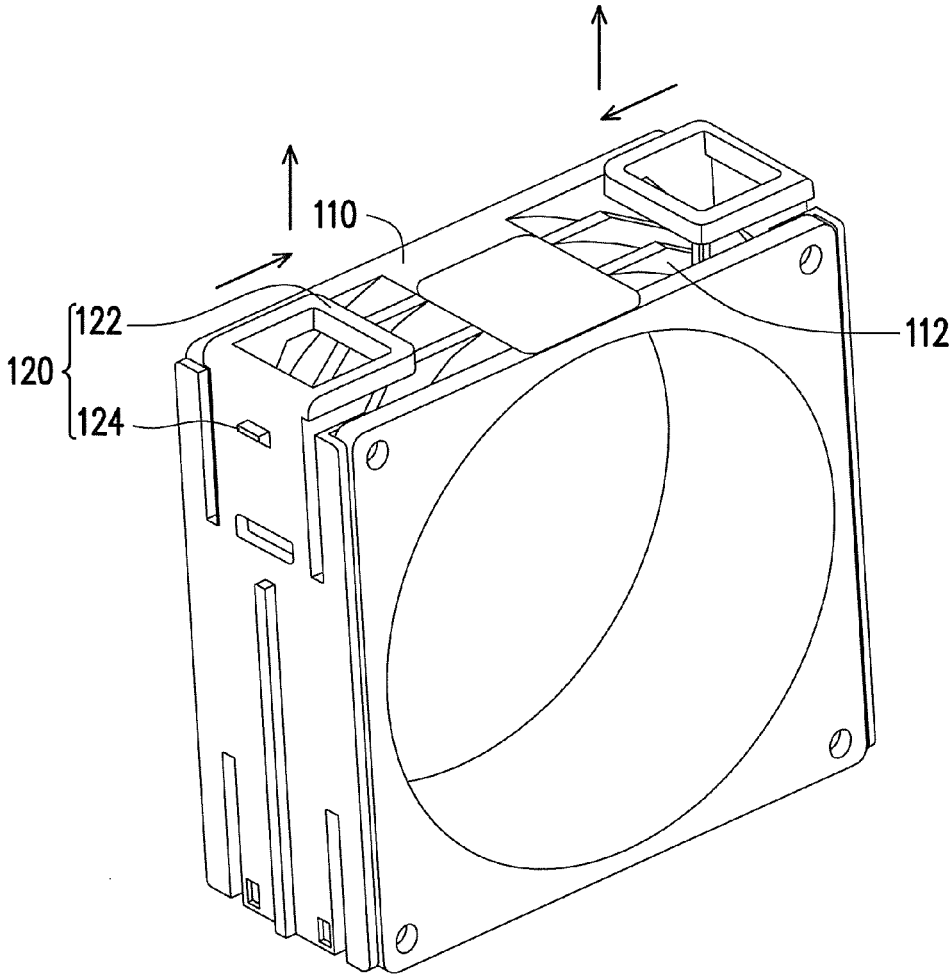
FIG. 1A(PRIOR ART)
FIGS. 1A and 1B illustrate a conventional fan and fan rails thereof.
Figure 1B:
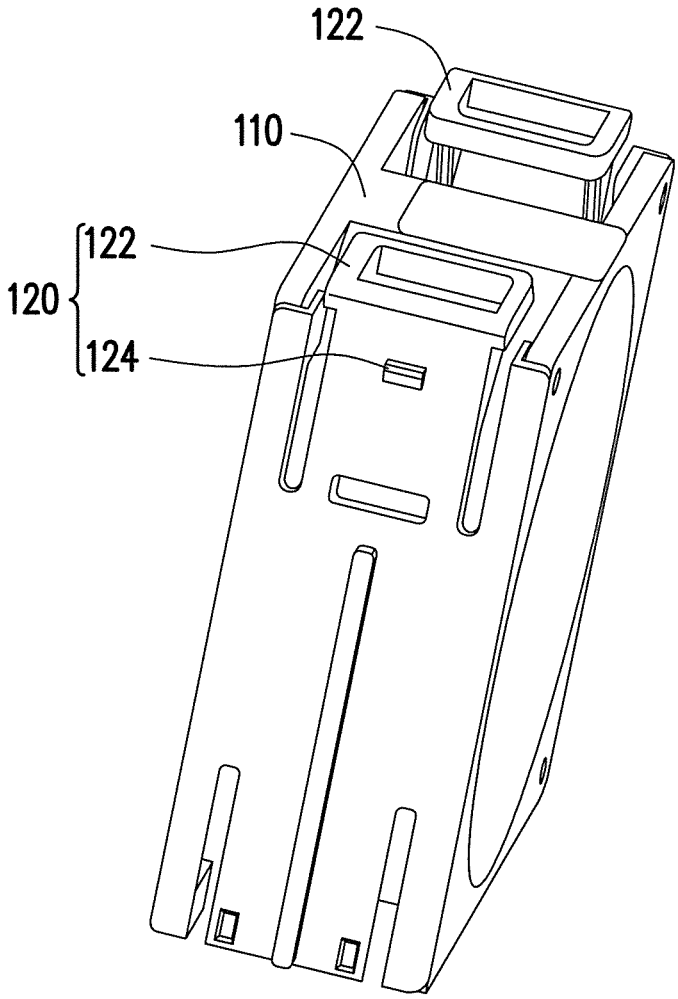
FIG. 1B(PRIOR ART)

In the prior art, a user inserts two fingers into the ring portions of the elastic arms 122 of the two fan rails 120 as shown in FIG. 1A and pulls the ring portions in opposite directions, however, the reinforcing ribs 112 corresponding to the ring portion occupies the space and obstructs the fingers, it is hard to draw the two elastic arms 122 closer with each other for detaching the fan 110.

Instead, the ring-pull 220 of the fan rail 200 of the present invention can rotate toward the fan 300 with respect to the main body 210 to fix the fan 300 in the holder 400; or, the ring-pull 220 of the fan rail 200 can rotate far away from the fan 300 with respect to the main body 210, such that the fan rail 200 of the present invention can be applied on a fan with or without the reinforcing ribs 112 as shown in FIG. 1A. More specifically, as the fan 300 is provided with the reinforcing ribs 112 as shown in FIG. 1A, users can insert their fingers into the tab portion 222 to rotate the ring-pull 220 to be in the unlock state and far away from the reinforcing ribs 112; therefore, the users can draw the fan 300 out from the holder 400 conveniently and excuse from a difficulty of applying force. If the fan is provided without the reinforcing ribs 112, two forces in opposite directions can be directly applied to the ring portions 222 to draw the two ring portion 222 closer with each other for releasing the engagement between the stopping block 226 and the slot 402, and then the assembly 350 of the fan and the fan rails are dragged to draw the assembly 350 out from the holder 400.

As to the above, the main body 210 may further has an opening 216 at the first end 212, and the opening 216 is adjacent to the accommodating portion 212*a* and located between the two elastic arms 212*d*. The arrangement of the opening 216 improves the elasticity of the first end 212, so as to prevent the first end 212 form damage due to an overloading in rotating the ring-pull 220.

Therefore, users can drag the tab portion 222 of the ring-pull 220 by fingers and then rotate the tab portion 222 along the pivot portion 224 with respect to the main body 210.

In summary, the fan rail of the present invention includes the main body and the ring-pull capable of rotating with respect to the main body. By assembling the fan rails to the fan, users can hold the assembly of the fan and the fan rails conveniently and install the assembly into the holder. In addition, since the ring-pull of the fan rail of the present invention can rotate with respect to the main body, the fan rail can be applied to the fan with or without reinforcing ribs. In the case of a high speed fan having reinforcing ribs, when users want to replace the fan, the ring-pull can be rotated with respect to the main body, and the users can insert their fingers into the tab portion of the ring-pull to drag the fan without a problem that the reinforcing ribs obstruct the fingers and the users are hard to pull the tab portions. In other words, the fan rail and the fan applying the fan rail of the present invention facilitate to install or detach the fan.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A fan rail, comprising:

a main body, having four elastic arms, two of the elastic arms at opposite sides of a first end of the main body, and the other two elastic arms are located at opposite sides of a second end of the main body; and a ring-pull having a tab portion and a pivot portion, wherein the pivot portion is pivoted with the first end of the main body, and the tab portion is adapted to rotate along the pivot portion with respect to the main body to be parallel to the main body.

2. The fan rail as claimed in claim 1, wherein the first end has an accommodating portion and two protrusions, the two protrusions are respectively located on opposite side walls of the accommodating portion, and the pivot portion has two recesses respectively coupled with the two protrusions.

3. The fan rail as claimed in claim 2, wherein the recesses are connected with each other to form a through hole.

4. The fan rail as claimed in claim 2, wherein the main body further has an opening adjacent to the accommodating portion and located between the two elastic arms at the first end.

5. The fan rail as claimed in claim 1, wherein the ring-pull further has a stopping block disposed at a side of the pivot portion far away from the tab portion.

6. A fan module, comprising:

a fan;

two fan rails disposed at opposite sides of the fan respectively, each of the fan rails comprising:

a main body, having four elastic arms, two of the elastic arms are located at opposite sides of a first end of the main body, and the other two elastic arms are located at opposite sides of a second end of the main body;

a ring-pull having a tab portion and a pivot portion, wherein the pivot portion is pivoted with the first end of the main body; and a holder, wherein the fan is installed in the holder through the fan rails, and the fan is adapted to be drawn out from the holder in an unlock state by rotating the tab portion of each of the fan rails along the pivot portion with respect to the main body to be parallel to the main body and applying a pulling force to the tab portion.

7. The fan module as claimed in claim 6, wherein the first end of the main body has an accommodating portion and two protrusions, the two protrusions are respectively located on opposite side walls of the accommodating portion, and the pivot portion has two recesses respectively coupled with the two protrusions.

8. The fan module as claimed in claim 7, wherein the recesses are connected with each other to form a through hole.

9. The fan module as claimed in claim 6, wherein each of the elastic arms has an assembling bump and the fan has a plurality of assembling holes arranged for being engaged with the corresponding assembling bumps.

10. The fan module as claimed in claim 7, wherein the main body further has an opening adjacent to the accommodating portion and located between the two elastic anus at the first end.

11. The fan module as claimed in claim 6, wherein each of the ring-pulls further has a stopping block disposed at a side of the pivot portion far away from the tab portion, and the holder has a plurality of slots at its opposite sides for engaging the stopping blocks as the ring-pull is in a lock state.

* * * * *